US008127973B2

(12) United States Patent
Mirkovic et al.

(10) Patent No.: US 8,127,973 B2
(45) Date of Patent: Mar. 6, 2012

(54) MULTI-CHANNEL PERFORATED TICKET SEPARATION MECHANISM

(75) Inventors: Zoran Mirkovic, Lebanon, OH (US); Joseph C. Perin, Jr., Cincinnati, OH (US)

(73) Assignee: Intralot, Inc., Duluh, GA (US)

( * ) Notice: Subject to any disclaimer, the term of this patent is extended or adjusted under 35 U.S.C. 154(b) by 649 days.

(21) Appl. No.: 12/332,415

(22) Filed: Dec. 11, 2008

(65) Prior Publication Data

US 2009/0152292 A1 Jun. 18, 2009

Related U.S. Application Data

(60) Provisional application No. 61/013,686, filed on Dec. 14, 2007.

(51) Int. Cl.

| | |
|---|---|
| ***B26F 3/00*** | (2006.01) |
| ***B26F 3/02*** | (2006.01) |
| ***G07F 11/16*** | (2006.01) |
| ***B65H 35/10*** | (2006.01) |

(52) U.S. Cl. ..... 225/100; 225/4; 225/103; 221/258

(58) Field of Classification Search ..... 225/100, 225/1, 4, 103, 105, 5, 104, 106; 83/340, 83/341, 342, 595, 596, 672; 463/17, 25; 221/258

See application file for complete search history.

(56) References Cited

U.S. PATENT DOCUMENTS

| | | | | | |
|---|---|---|---|---|---|
| 2,419,012 | A | * | 4/1947 | Dodegge | 83/205 |
| 3,185,066 | A | * | 5/1965 | Mason et al. | 355/107 |
| 3,502,252 | A | * | 3/1970 | Remo | 225/33 |
| 3,744,360 | A | * | 7/1973 | Currie et al. | 83/23 |
| 4,473,218 | A | * | 9/1984 | Dudek | 270/52.12 |
| 4,588,982 | A | | 5/1986 | Goodwin | |
| 4,877,230 | A | | 10/1989 | Winkler et al. | |
| 4,982,337 | A | | 1/1991 | Burr et al. | |
| 5,160,076 | A | | 11/1992 | Ford | |
| 5,222,624 | A | | 6/1993 | Burr | |
| 5,833,104 | A | * | 11/1998 | Horniak et al. | 225/106 |
| 5,950,898 | A | | 9/1999 | Menna | |
| 6,036,052 | A | | 3/2000 | Tong | |
| 6,109,472 | A | * | 8/2000 | Gibier | 221/33 |

(Continued)

FOREIGN PATENT DOCUMENTS

WO 9952691 A1 10/1999

OTHER PUBLICATIONS

International Searching Authority, International Search Report and Written Opinion, PCT/US2008/086196, Feb. 10, 2009, 8 pgs.

*Primary Examiner* — Ghassem Alie

(74) *Attorney, Agent, or Firm* — Wood, Herron & Evans, LLP

(57) ABSTRACT

A multi-channel separation mechanism assembly for a lottery or other ticket dispensing machine includes a separate detachable feed mechanism associated with each separate feed channel, such that the feed mechanism for a single channel can be removed and replaced without replacing the entire assembly. Each such detachable feed mechanism includes a compact transmission wherein drive is efficiently transferred from a vertically-oriented feed motor to horizontally-oriented feed rollers. Each feed channel is additionally equipped with a bidirectional mechanical flag which triggers an optical sensor to detect presence of a ticket strip in the channel while still allowing appropriate reverse motion of the ticket strip within the associated channel.

8 Claims, 9 Drawing Sheets

U.S. PATENT DOCUMENTS 6,131,506 A * 10/2000 Kemper ..... 99/425
6,152,443 A 11/2000 Claramunt et al.
6,225,265 B1 5/2001 Shibuya et al.
6,726,077 B2 * 4/2004 Roberts et al. ..... 225/103
6,886,728 B2 5/2005 Roberts et al.
6,932,258 B1 8/2005 Roberts et al.
7,032,793 B2 4/2006 Roberts et al.
2002/0117528 A1 * 8/2002 Turek ..... 225/4
2003/0146232 A1 * 8/2003 Yang ..... 221/71
2004/0000572 A1 * 1/2004 Engelhardt et al. ..... 225/1

* cited by examiner

MULTI-CHANNEL PERFORATED TICKET SEPARATION MECHANISM

CROSS-REFERENCE TO RELATED APPLICATIONS

This application claims priority to U.S. Provisional Application No. 61/013,686, filed Dec. 14, 2007, which is hereby incorporated by reference.

FIELD OF THE INVENTION

This invention relates to item dispensers and more particularly, to an apparatus and method for dispensing tickets from strips of tickets.

BACKGROUND OF THE INVENTION

Various types of machines have been developed for dispensing and vending lottery tickets that are printed in long strips, wherein each ticket is separable from another ticket by a perforation line. The tickets are generally stored in a fan-fold form in a vending machine and are dispensed upon the customer paying for the tickets. The tickets are printed on a relatively heavy stock and hence, have some stiffness but are flexible. The tickets can vary substantially in size and thickness depending on the lottery game, the design by the issuer of the ticket, etc. Examples of such machines are disclosed in U.S. Pat. Nos. 4,982,337; 5,160,076; 5,222,624; 6,726,077; 6,886,728; 6,932,258; 7,032,793 and U.S. Patent Application Publication No. 2004/0000572. Each of these patent properties is hereby incorporated by reference in its entirety.

Ticket dispensers such as lottery ticket dispensers are often distributed throughout a wide geographic area within which the tickets are sold, and the ticket dispensers are located in a wide range of retail environments. Further, the ticket dispensers may be stand-alone machines with little or no supervision. Therefore, it is important that the ticket dispensers operate very reliably over extended periods of time. A total failure of a ticket dispenser preventing it from dispensing tickets results in a substantial loss of revenue; and in addition, such a failure incurs a substantial cost in having to service the ticket dispenser in the field.

However, partial failures of a ticket dispenser can also be costly. For example, if the vending machine has multiple channels to dispense a variety of tickets, failure of a ticket separation mechanism that services all of the channels requires servicing and/or replacement of the entire mechanism. Needless to say, such a situation is very problematic to the issuer of the lottery ticket as well as the customer.

Another potential cause of improper ticket dispenser operation is the transmission driven mechanism feeding the supply of tickets to the separation mechanism for discharge to the customer. The arrangement of the ticket feed mechanism in many known systems is generally not optimized for compactness because of mechanical difficulties and expense involved in the axis of drive rotation.

Another problem with known ticket dispensers is the difficulty in unloading the last ticket in a strip of tickets. Some prior ticket dispensers include a ticket detection flag that will block the ticket and prevent unloading of the ticket channel. In such a situation, the removal of the last ticket can become time-consuming and mechanically involved.

Thus, there is a need for a ticket dispenser that is not only more reliable in operation but also easier to service when needed.

SUMMARY OF THE INVENTION

These and other disadvantages with prior art lottery ticket dispensers have been addressed with this invention, which includes a multi-channel ticket separation mechanism. The multi-channel separation mechanism assembly according to one embodiment of this invention includes a separate detachable feed mechanism associated with each separate ticket feed channel, such that the feed mechanism for a single channel can be removed and replaced without replacing an assembly servicing all of the ticket channels.

The feed mechanism according to another embodiment of this invention includes a compact transmission wherein drive is efficiently transferred from a vertically-oriented feed motor to horizontally-oriented feed rollers, providing efficient power transfer, a compact geometry, and flexible placement of drive train components.

Each ticket feed channel according to another embodiment of this invention is equipped with a bidirectional mechanical flag, which triggers an optical sensor to detect presence of a ticket in the channel while still allowing appropriate reverse motion of the ticket.

BRIEF DESCRIPTION OF THE DRAWINGS

The objectives and features of the invention will become more readily apparent from the following detailed description taken in conjunction with the accompanying drawings in which:

FIG. 9 is a schematic side cross sectional view of the multi-channel ticket separation mechanism of FIG. 8 taken through the center of a bi-directionally capable ticket present sensor flag with the front end of a ticket beginning to feed there through;

FIG. 12 is a view similar to FIG. 9 with the rear end of a ticket beginning to feed there through.

DETAILED DESCRIPTION OF THE INVENTION

A ticket separation mechanism for lottery ticket dispensers operates by the use of two sets of feed rollers: bin rollers and exit rollers. Each of the sets of rollers may have a separate motor associated with it. Strips of lottery or other types of serially connected tickets feed into the bin rollers and past a separation zone. A separation mechanism separates the ticket strip at a perforation joining adjacent tickets such that the tickets in front of the separation zone can be dispensed while the strip behind the separation zone remains within the machine. The separation mechanism may be a burster such as that disclosed in U.S. Pat. No. 4,982,337, a cutter or other device known in the art. The exit rollers, on the other side of the separation zone, feed the tickets out to the ticket dispensing area to be received by the customer. In a multi-channel assembly, each of the multiple channels may include its own set of bin rollers and exit rollers to feed the ticket strip associated with that channel.

Figure 1:
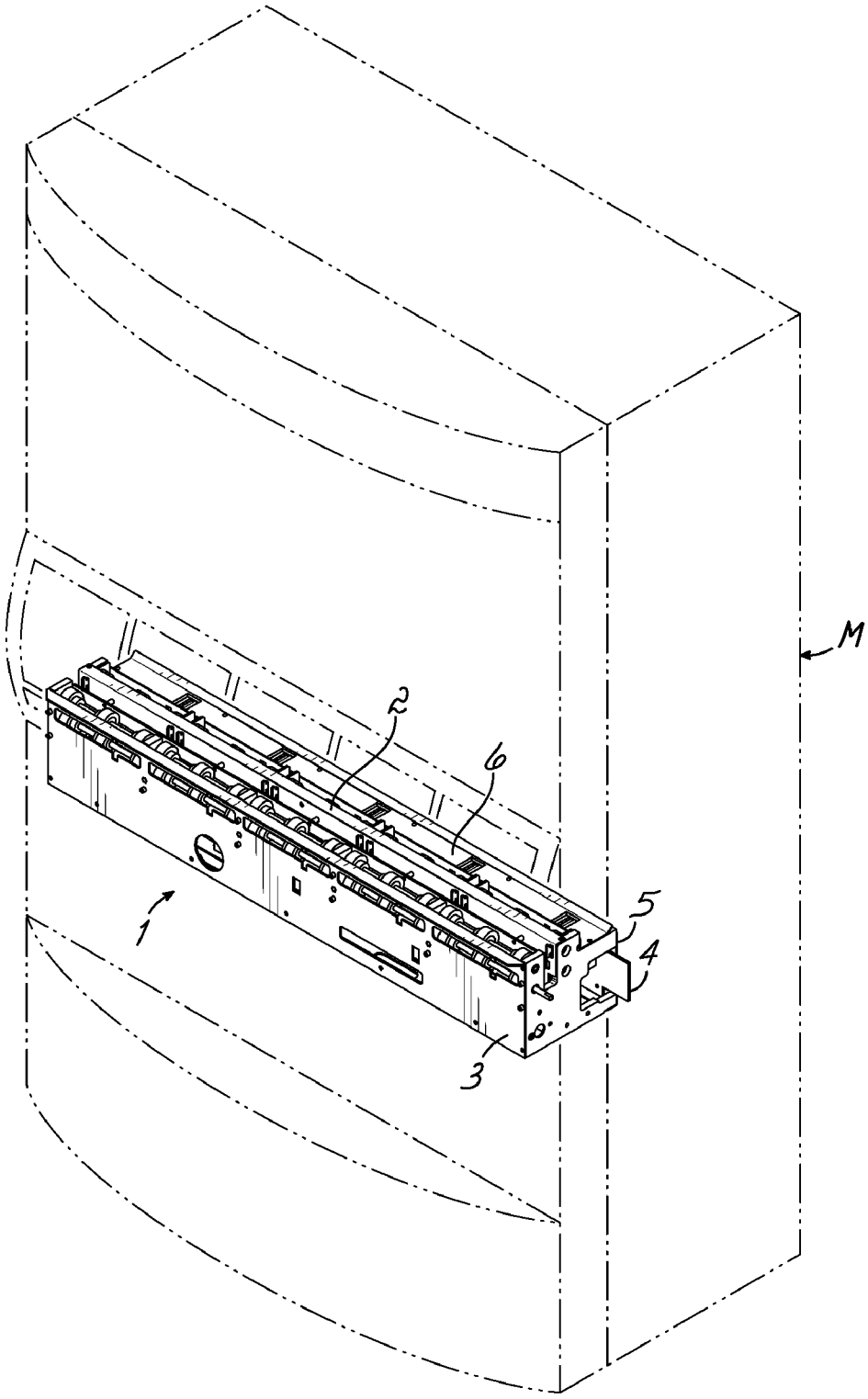
FIG. 1 is an isometric front view of a multi-channel separation mechanism assembly with phantom lines to show a ticket dispensing machine according to one embodiment of this invention.

Turning to the drawings, FIG. 1 shows a multi-channel separation mechanism 1 placed within a lottery ticket dispenser or vending machine M as shown by the broken lines in FIG. 1. As shown, the multi-channel ticket separation mechanism 1 may be housed within a long, rectangular metal housing structure including front, rear, and top housing plates 3, 5, and 6, and may be positioned proximate to a ticket dispensing area on the machine that includes external slots where the customer can retrieve their tickets.

Figure 2:
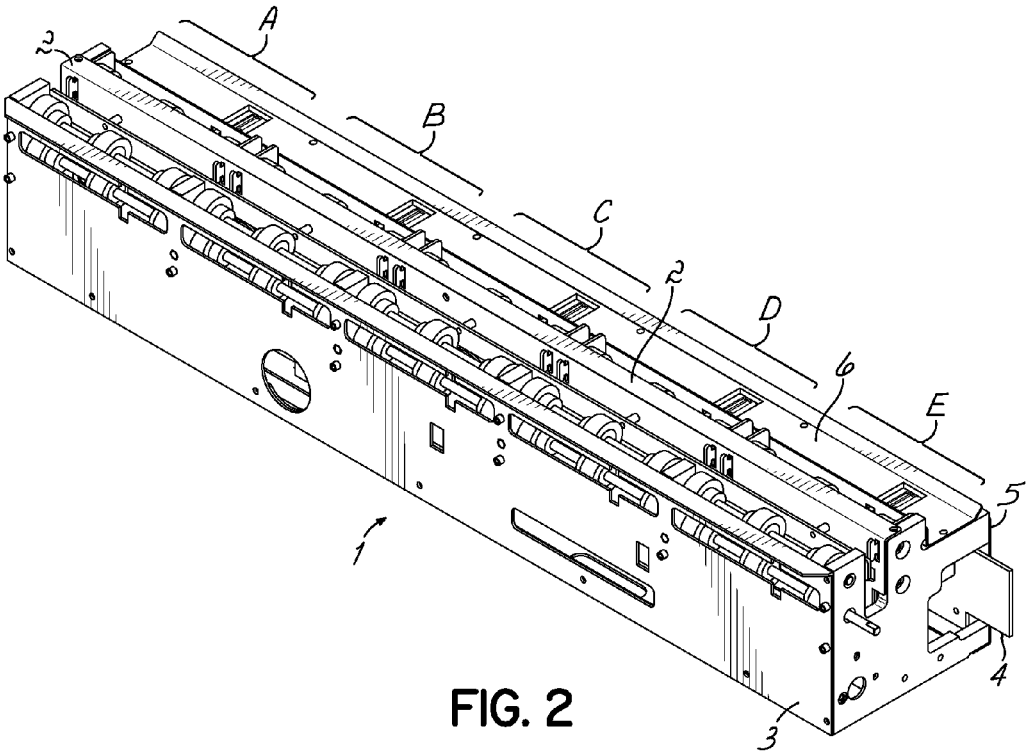
FIG. 2 is an isometric front view of the multi-channel separation mechanism assembly of FIG. 1.

As shown in FIG. 2, the multi-channel ticket separation mechanism 1 may include five different ticket channels A-E for dispensing a ticket, the channels located side-by-side and feeding strips of serially connected tickets substantially in parallel. Each ticket dispensing channel A-E may include its own slot in the front plate 3, as well as including its own bin and exit feed mechanism 10. The multi-channel ticket separation mechanism 1 may be significantly longer than it is wide, such that each ticket channel feeds across the relatively short width of the multi-channel ticket separation mechanism 1 while the mechanism 1 can accommodate each of the multiple dispensing channels A-E. Although the exemplary embodiments herein show five channels, more or fewer channels could be accommodated without departing from this invention. A printed circuit board 4 may be found within the housing for the multi-channel ticket separation mechanism 1, and may run the length of the mechanism 1 so as to control each of the feed mechanisms 10.

Figure 3:
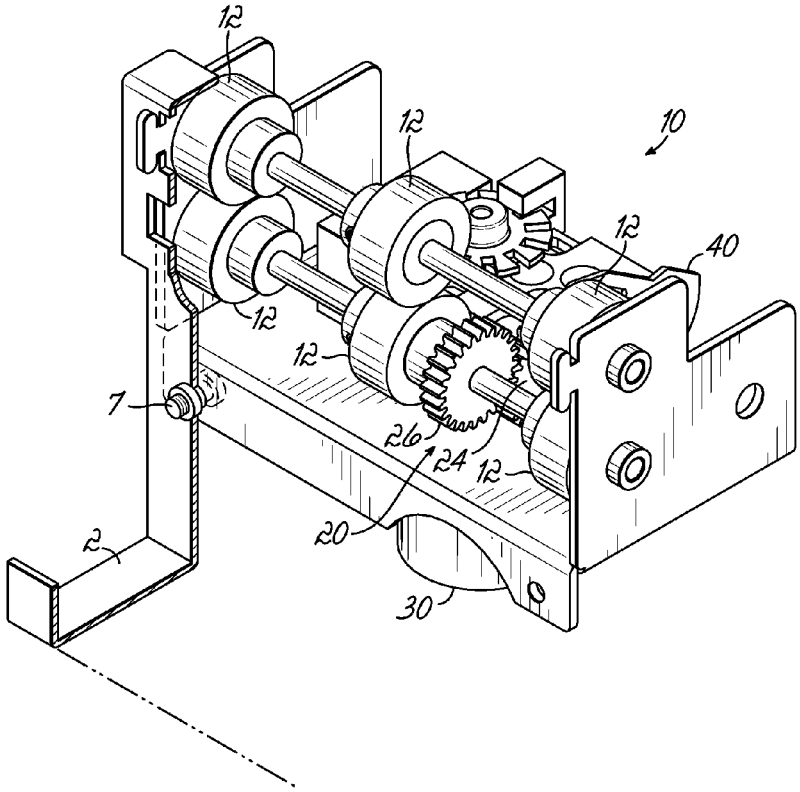
FIG. 3 is an isometric front view of an individual modular feed mechanism of the assembly of FIG. 1 including a portion of its mounting plate.

FIG. 3 shows the modular feed mechanism 10 along with a small portion of its associated mounting plate 2. Bin feed rollers 12 are connected to gears that form a transmission 20. The feed mechanism 10 is mounted to the mounting plate 2 at least in part by use of a fastener 7, which may be a screw or other appropriate fastener.

Figure 4:
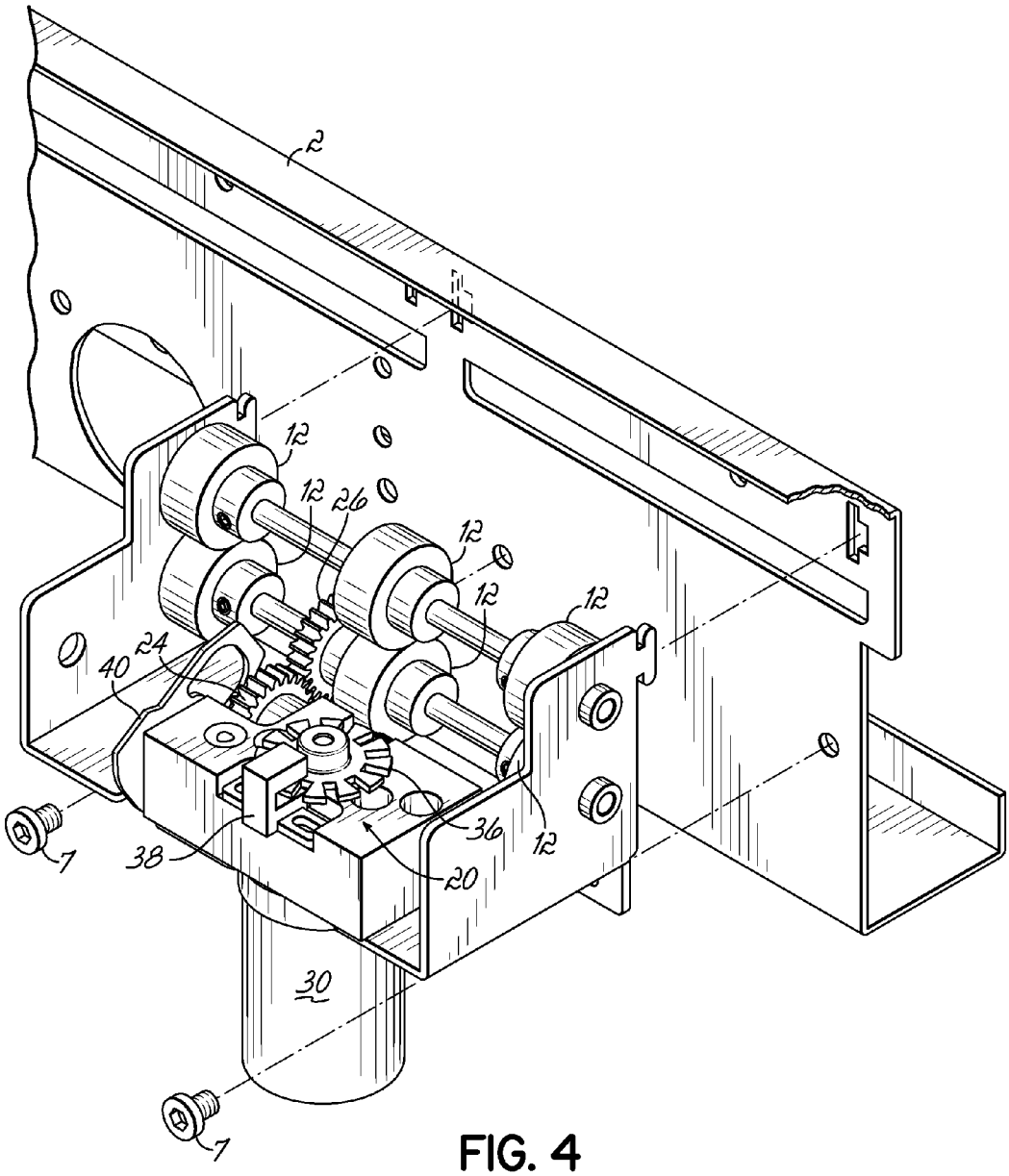
FIG. 4 is an isometric rear view of the individual modular feed mechanism of FIG. 3 including a portion of its mounting plate.

FIG. 4 shows the modular feed mechanism 10 including a drive motor 30 which may be positioned at the bottom of the feed mechanism 10. The drive motor 30 may be a stepper motor with a substantially vertical axis of rotation including a drive shaft 32 extending vertically upward and into the plane of a remainder of the feed mechanism 10 and positioned in back of the bin feed rollers 12. A transmission 20 is connected to the drive shaft 32 and provides substantially horizontal drive to the bin feed rollers 12. The transmission 20 is designed to provide drive to the rollers 12 in either a forward or reverse direction.

Figure 5:
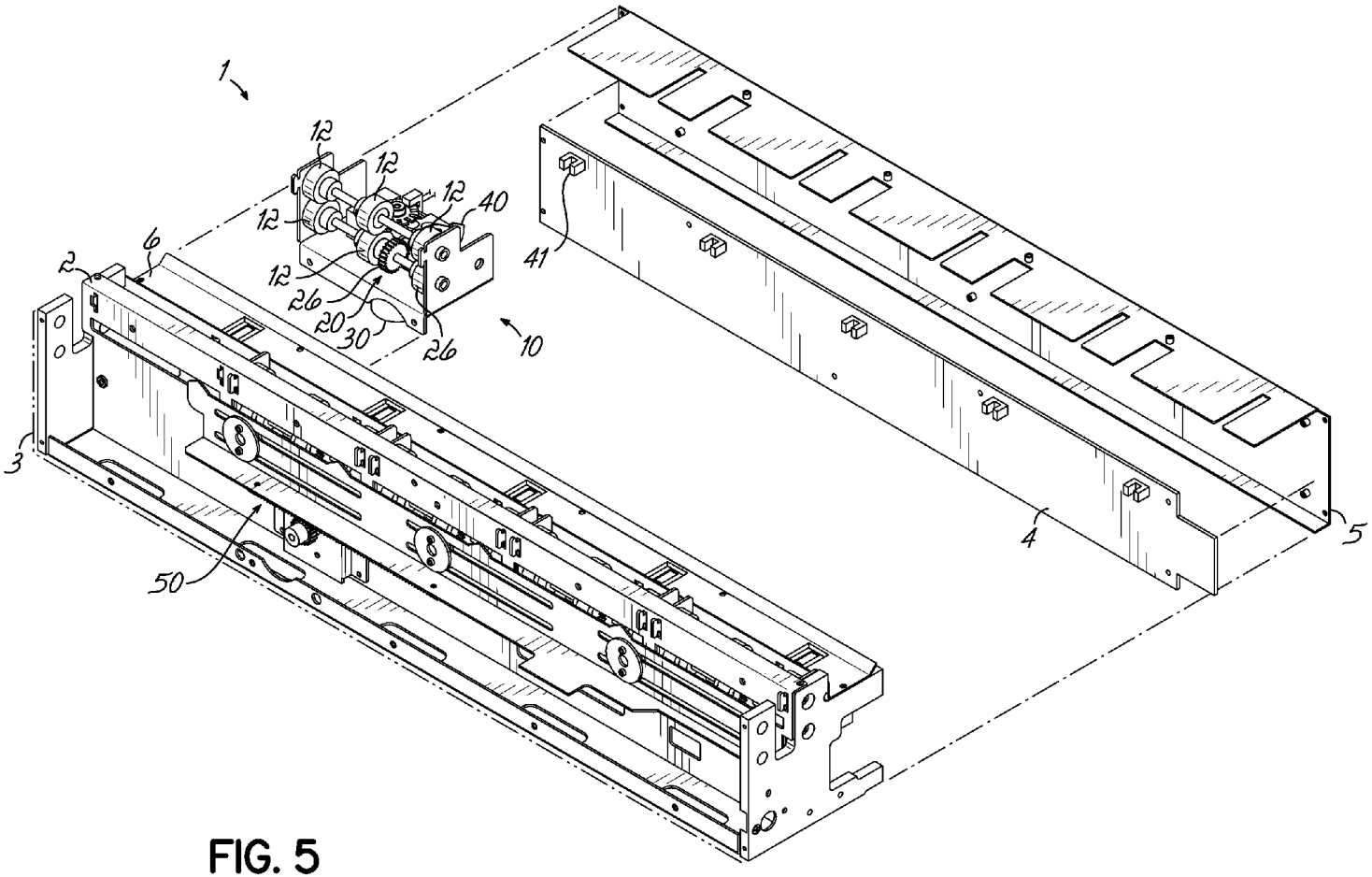
FIG. 5 is an isometric front view of the multi-channel ticket separation mechanism, partially disassembled.

FIG. 5 shows an exploded view of some of the components of the multi-channel ticket separation mechanism 1. In accordance with this invention, the feed mechanism 10 including the bin feed rollers 12, drive motor 30, and associated transmission 20 is modular so as to be easily separable from the remainder of the multi-channel ticket separation mechanism 1. The elongated mounting plate 2 runs the full length of the multi-channel ticket separation mechanism 1, providing a mounting surface for each of the individual feed mechanisms 10 associated with each ticket dispensing channel A-E. Located on an opposite side of the feed mechanisms 10 is a printed circuit board 4 which extends the length of the assembly 4 and is mounted to the rear housing plate 5 that forms the outer housing of the multi-channel ticket separation mechanism 1.

Figure 6:
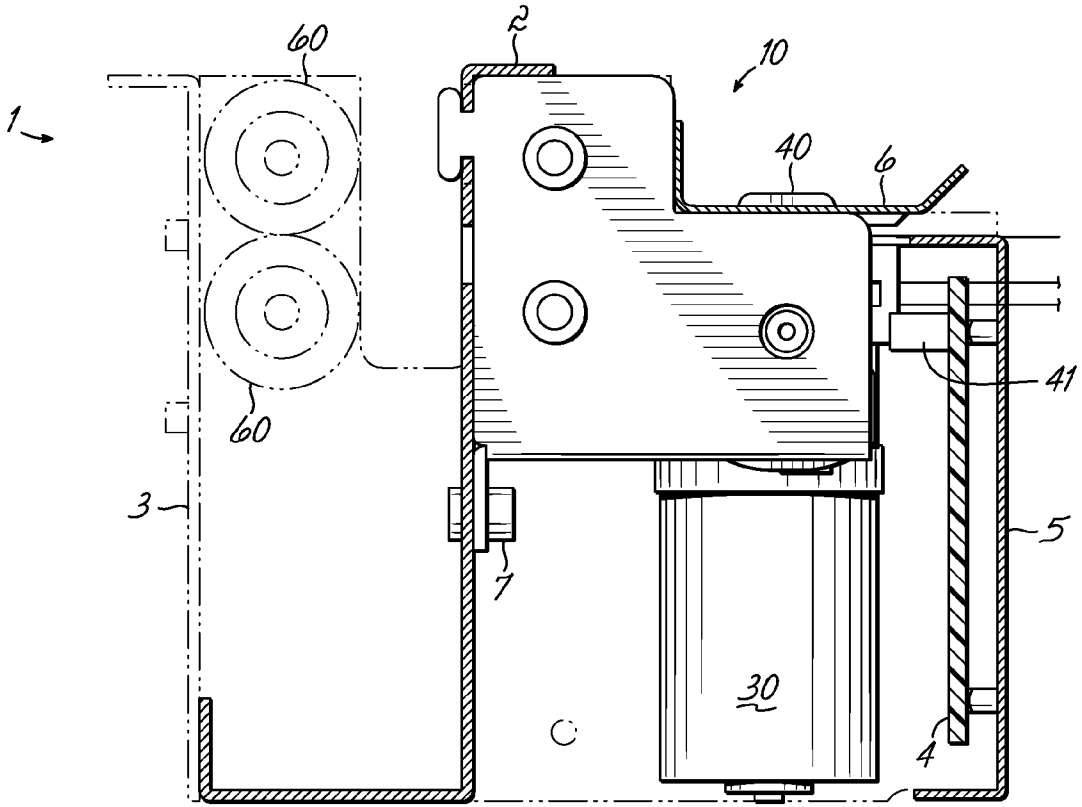
FIG. 6 is a schematic side cross sectional view of the individual modular feed mechanism, mounting plate, back cover plate, and top cover plate of FIG. 5 with phantom lines to show the rest of the multi-channel separation mechanism.

As shown in FIG. 6, the mounting plate 2, printed circuit board 4, and rear plate 5 sit on either side the modular feed mechanism 10 with a top plate 6 located there above. Although the modular feed mechanism 10 is attached to the mounting plate 2, in one embodiment, no fasteners extend from either the top plate 6 or the rear plate 5 in order to engage the modular feed mechanism 10. Thus, the modular feed mechanism 10 is secured to the housing with the benefit of the fasteners 7 associated with the mounting plate 2. The circuit board 4 is connected to various sensors and other electronic components of the mechanism 10 as known in the art. The top and rear plates, which extend the length of the assembly 1, are fastened to the ends of the multi-channel ticket separation mechanism 1.

Figure 7:
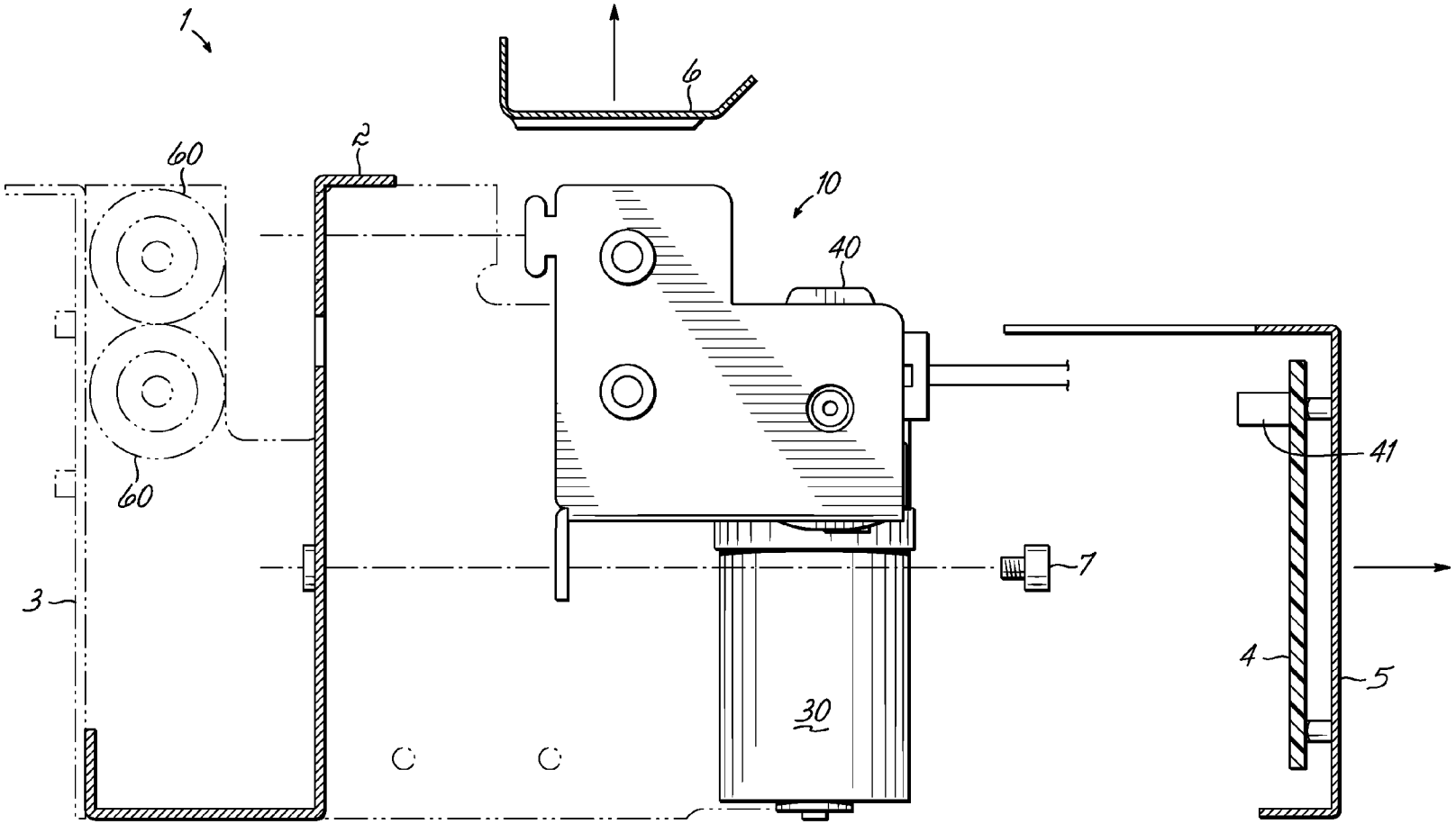
FIG. 7 is a view similar to FIG. 6 showing the elements of the ticket separation mechanism being disassembled for access to the individual modular feed mechanism.

FIG. 7 shows the ease with which the multi-channel ticket separation mechanism 1 of this invention may be assembled, disassembled and re-assembled as needed according to one embodiment of this invention. The top and rear plates 5 and 6 are moved outward from the multi-channel ticket separation mechanism 1 in the top and rear directions, respectively, to provide access to the feed mechanism 10. The fasteners 7 are removed (in FIG. 7, unscrewed) in order to detach the modular feed mechanism 10 from the mounting plate 2. An individual feed mechanism 10 can be removed and, if necessary, replaced, all without disturbing the other modular feed mechanisms 10 associated with each of the other channels in the multi-channel ticket separation mechanism 1.

Figure 8:
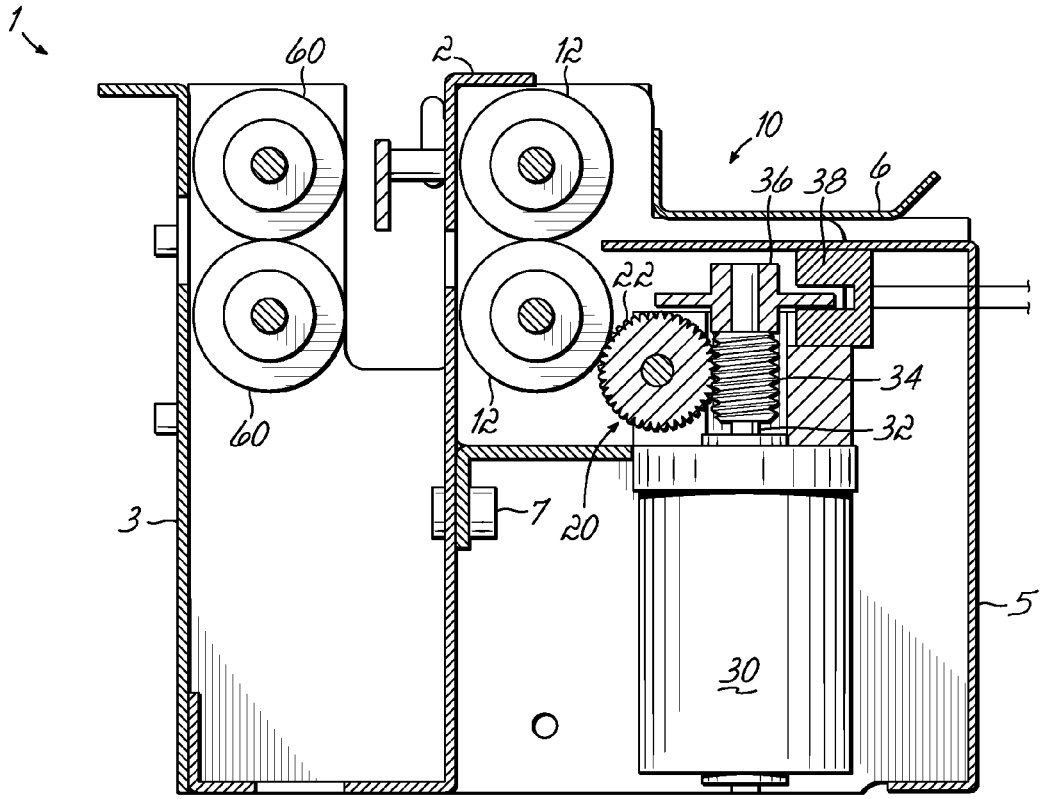
FIG. 8 is a schematic side cross sectional view of the multi-channel ticket separation mechanism of FIG. 5 taken through the center of an individual modular feed mechanism feed motor transmission.
Figure 9:
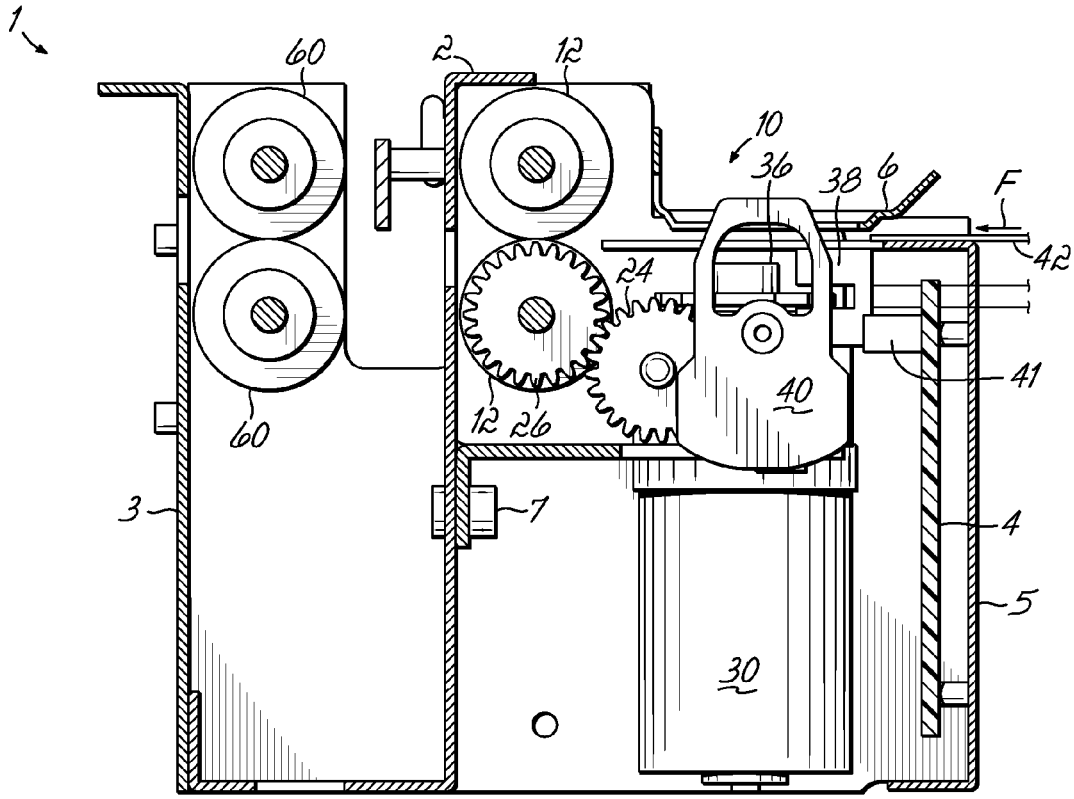

FIG. 8 shows a cross-section of the transmission 20 according to one embodiment of this invention. The vertically-extending drive shaft 32 includes a worm gear 34. A standard pinion gear 22 is located forward of the drive shaft 32 with a horizontal axis of rotation. The gear 22 meshes with the worm gear 34 to change the direction of drive rotation and convey the drive torque as part of the transmission 20. As shown in FIGS. 8 and 9, the drive force is conveyed from the drive motor 30 via the drive shaft 32, through the worm gear 34, and into the gear 22 with a horizontal axis of rotation. The gear 22 is mounted on a shaft oriented parallel to the axis of the bin feed rollers 12. The gear 22 shares a shaft with a gear 24, which couples with a gear 26, which shares a shaft with the lower roller of the bin feed rollers 12. The worm-and-gear set of the transmission 20 allows for the feed mechanism 10 to be contained in a compact structure as required for the modular nature of the multi-channel ticket separation mechanism 1.

Figure 10:
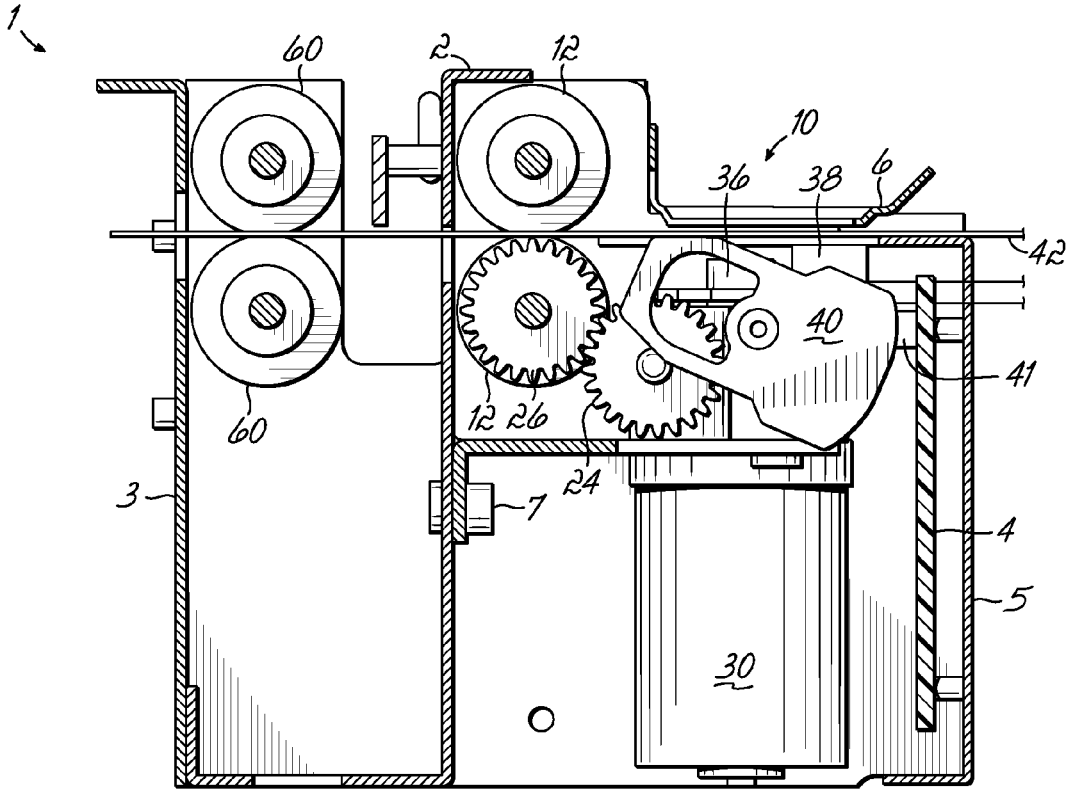
FIG. 10 is a view similar to FIG. 9 with tickets fed completely through and showing the ticket present sensor flag rotated forward to indicate the presence of a ticket.

The feed mechanism 10 also includes a detection flag 40, which is a pivoting element that extends into the dispensing path for the ticket strip 42 located in the channel A-E. The detection flag 40 is biased by gravity to hang directly downward into a neutral position such that it will be contacted by a ticket strip 42 moving across the dispensing channel A-E in either direction, as shown in FIG. 9. When a ticket strip 42 is fed in the forward direction F within the channel A-E to be dispensed by the individual modular feed mechanism 10 as shown in FIG. 9, the ticket strip 42 feeds past the location of the detection flag 40 and moves the flag 40 into a forward position as shown in FIG. 10. An optical sensor 41 sits adjacent the flag 40 such that when the flag 40 hangs down into its neutral position it does not extend into a field of view of the optical sensor 41 and, therefore, does not trigger the optical sensor 41 from such a neutral position. However, once the flag 40 is moved into an offset or angled position as a result of contact by the ticket strip 42, the optical sensor 41 is triggered by the presence of the flag 40. This provides a signal that indicates that the channel associated with the mechanism 10 is occupied.

Figure 12:
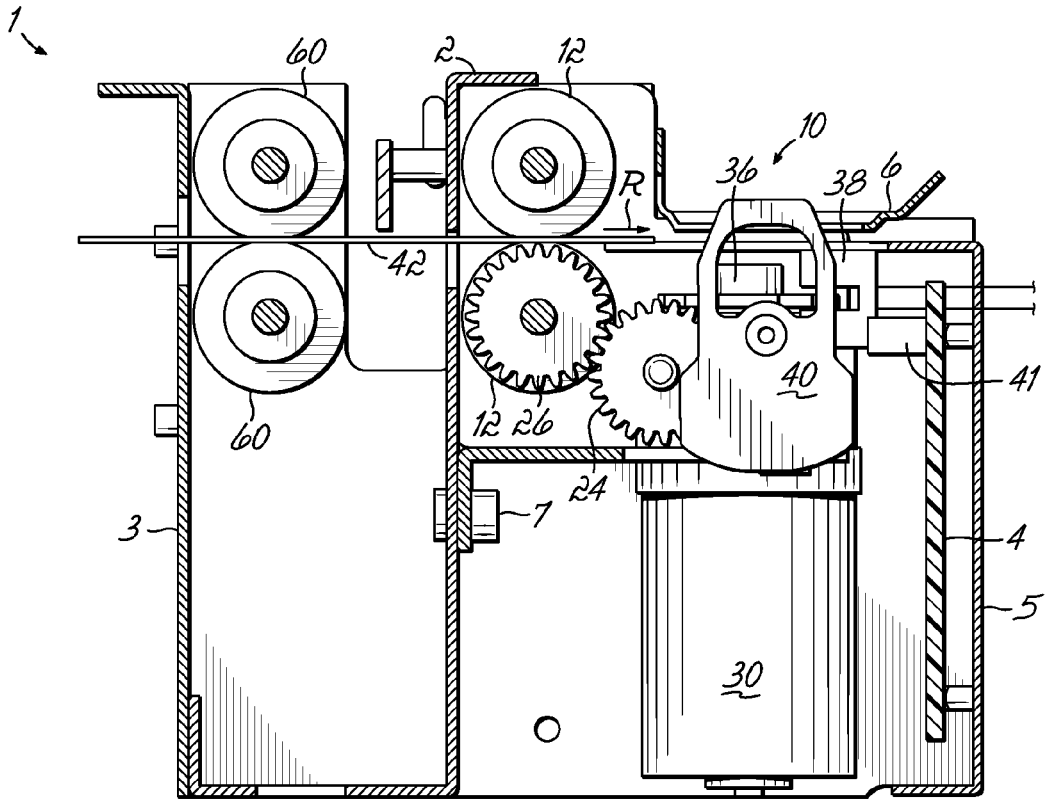
Figure 13:
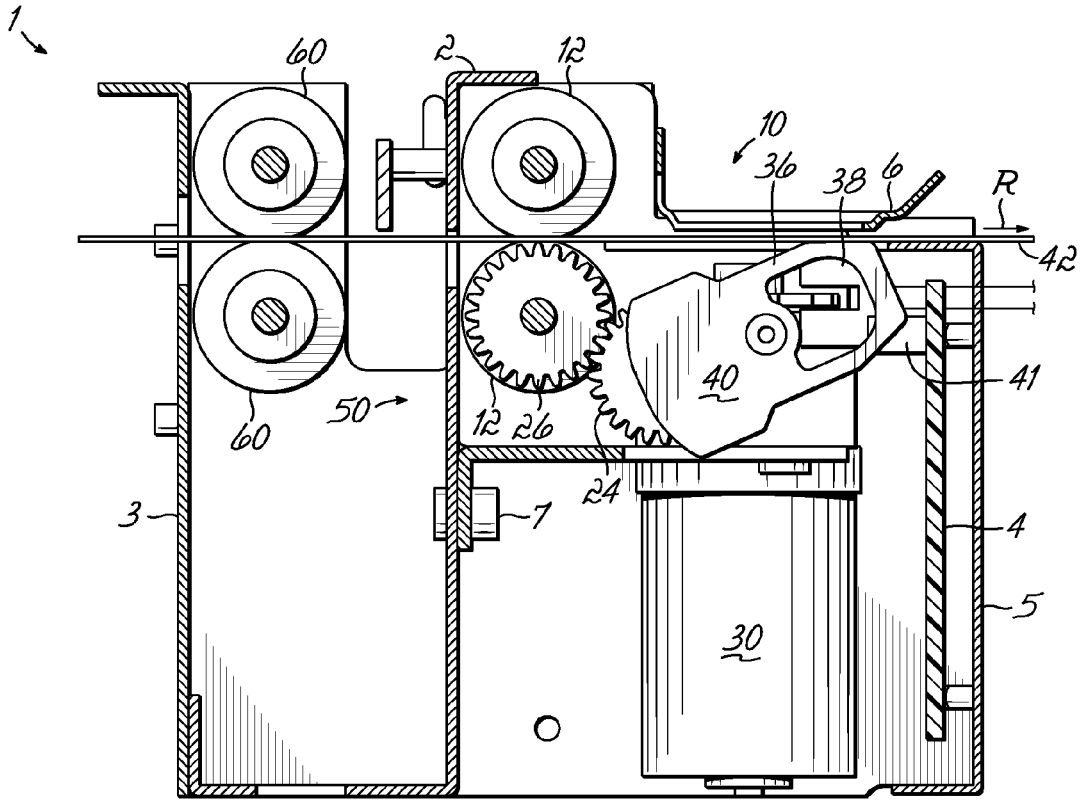
FIG. 13 is a view similar to FIG. 12 with tickets fed completely through and showing the ticket present sensor flag rotated backward to allow for the unloading of a ticket.

If the end of the ticket strip 42 moves past the detection flag 40, as would occur near the end of the ticket strip 42 when all but the final tickets in the strip have been dispensed, the detection flag 40 will return to its neutral position and out of the field of view of the optical sensor so as not to trigger the optical sensor 41, as shown in FIG. 12. In accordance with this invention, the detection flag 40 is further made to accommodate if the one or more remaining tickets of the ticket strip 42 are fed in the rearward direction R past the detection flag 40. The detection flag 40 is bidirectional, such that it will accommodate the tickets and move into a rearward position as shown in FIG. 13. As shown, the detection flag 40 triggers the optical sensor 41 when angled into the rearward position, the same as it does in the forward position. In another embodiment, the detection flag 40 triggers a different signal in the rearward position as differentiated when the detection flag 40 is in the forward position. In another embodiment, the detection flag 40 accommodates a rearward feed as disclosed, but does not trigger a sensor or result in a signal from its rearward position.

Figure 11:
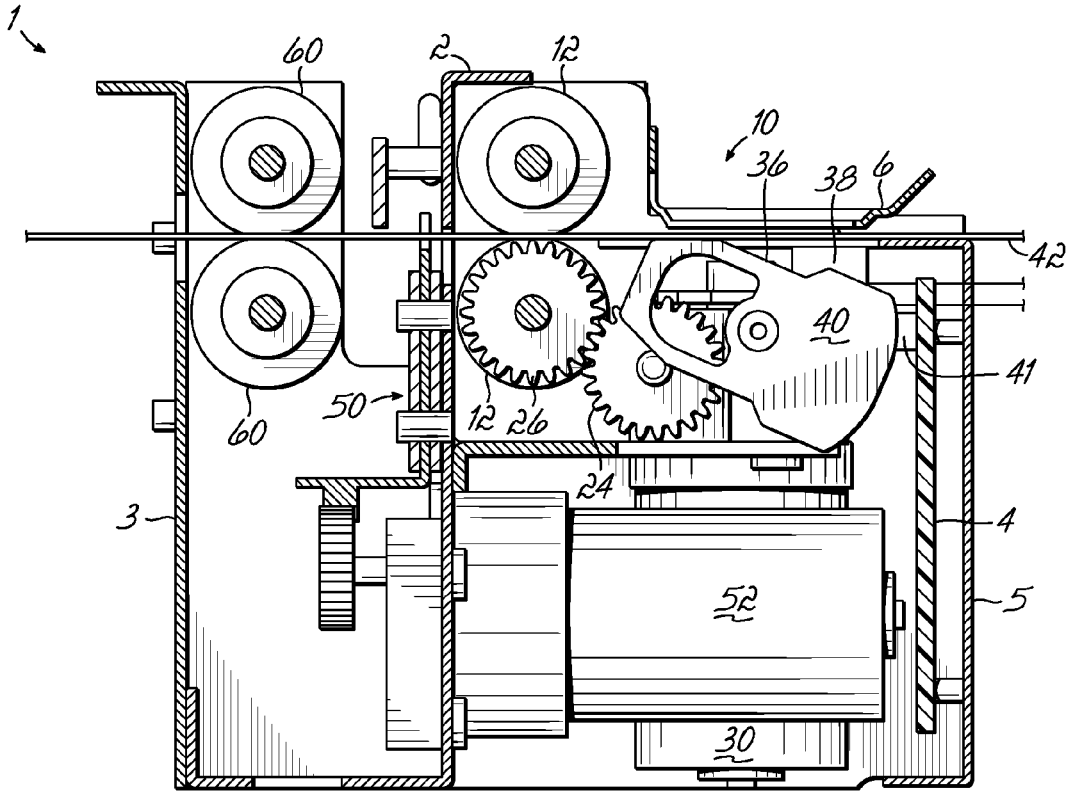
FIG. 11 shows the view of FIG. 10, further including a tearing bar and tearing bar drive motor assembly.

FIG. 11 shows the ticket separation mechanism in one embodiment according to this invention as a burster mechanism 50 associated with separating one or more tickets from the strip 42 by bursting the ticket strip 42 along a perforation (not shown) as known in the art. As shown in FIG. 5, the burster mechanism 50 may extend along the length of the multi-channel ticket separation mechanism 1 such that a single burster mechanism 50 is used for multiple ticket channels A-E. As shown, the burster mechanism 50 sits below the ticket dispensing channel paths and includes a set of protrusions that extend up into the plane of the ticket dispensing channel paths. When the burster 50 is not active, the protrusions are located to the side of the channel path such that they do not obstruct the path of the ticket strips 42. The burster mechanism 50 is configured to move along the length of the mechanism in order to separate tickets along a perforation in the strip 42 which is fed into the separation zone where the burster 50 is located. In one embodiment, the burster mechanism 50 may include a separate drive motor 52 as shown in FIG. 11. Alternatively, other ticket separation mechanisms may be employed within the scope of this invention.

In operation, the exit motor (not shown) driving the exit rollers 60 and bin motor 30 driving the bin feed rollers 12 are ramped up in tandem. It is anticipated that the two drive system velocities are matched, and so a fixed ratio is maintained between the two motors during the initial portion of the dispensing phase. This starts the ticket strip 42 moving in a forward direction F.

As shown in FIGS. 4 and 8, a bin motor encoder disk 36 is coupled to the bin motor drive shaft 32. An optical sensor 38 is coupled to the encoder disk 36 to track the movement of the bin motor 30 drive system. At the exit rollers 60, an optical sensor (not shown) detects the leading edge of the ticket strip 42. Once this is detected, an additional set distance is dispensed as detected by the sensor 38 coupled to the encoder disk 36. In one embodiment, the motors continue at a full velocity until a distance less than the set distance is detected as dispensed, then continue at a reduced velocity until the set distance is dispensed. Once the set distance is dispensed and the motors associated with the rollers 12, 60 have stopped, the bin motor 30 may be activated alone (not in tandem with the exit motor) in the rearward direction for a small, predetermined number of encoder counts before shutting off in order to make sure that the ticket strip 42 is separated along the designated perforation between adjacent tickets.

The motor 52 associated with the burster mechanism 50 is then initiated to separate the tickets to be dispensed from the remainder of the ticket strip 42. The bin motor 30 is then operated in reverse for a small number of counts to pull the ticket strip 42 back from the burster mechanism 50, while the exit motor is operated in a forward direction at full speed until the tickets to be dispensed clear the optical sensor before shutting off.

This multi-channel separation mechanism with compact, modular feed mechanisms associated with different channels allows for a more reliable and convenient ticket dispensing operation.

From the above disclosure of the general principles of this invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A ticket dispensing apparatus comprising:

a plurality of modular parallel feed mechanisms arranged to feed tickets from the respective feed mechanism in parallel with each of the other feed mechanisms, each feed mechanism including a separate drive motor and feed rollers, each mechanism being individually detachable from the ticket dispensing apparatus without detaching any other of the plurality of feed mechanisms; each modular feed mechanism including a flag coupled to a sensor, the flag being configured to trigger the sensor only when a ticket is present within the feed mechanism; wherein the flag is mounted to move about a pivot axis to a first position when a ticket strip is fed into the mechanism from a first direction and to move about the pivot axis to a second position distinct from the first position when a ticket strip is fed into the mechanism from a second direction in opposition to the first direction such that the flag permits movement of a ticket strip in each of the first and second directions; and a ticket separation mechanism operable to separate tickets dispensed by the ticket apparatus, the ticket separation mechanism including a separate drive motor, the ticket separation mechanism being configured to separate designated tickets serviced by each of the plurality of modular feed mechanisms.

2. The ticket dispensing apparatus of claim 1 wherein each modular feed mechanism further comprises:

a drive shaft coupled to the drive motor, the drive motor configured to provide a driving torque in two opposed rotational directions; and a compact transmission system including a worm gear operatively coupled to the drive shaft and a pinion gear operatively coupled to the worm gear, the transmission system being configured to transmit bi-directional driving torque associated with each of the two opposed rotational directions of the drive motor;

wherein the feed rollers are operatively coupled to the transmission system such that the drive motor is configured to drive the feed rollers via the transmission system.

3. The ticket dispensing apparatus of claim 2 further comprising:

an encoding member operatively coupled to the drive shaft to rotate as the drive shaft rotates; and a sensor operatively coupled to the encoding member to track the movement of the drive shaft.

4. The ticket dispensing apparatus of claim 3 wherein the sensor is an optical sensor.

5. The ticket dispensing apparatus of claim 4 wherein the encoding member is a disk.

6. A ticket dispensing apparatus of claim 1 wherein the ticket separation mechanism further comprises:

a burster operable to separate adjacent tickets along a line of weakness joining the adjacent tickets together.

7. The ticket dispensing apparatus of claim 1 further comprising:

a plurality of discrete ticket dispensing channels, each of which is associated with one of the modular feed mechanisms.

8. The ticket dispensing apparatus of claim 7 further comprising:

a plurality of discrete ticket exits, each of which is associated with one of the ticket dispensing channels.

* * * * *